US007281877B1

(12) United States Patent
Lederer et al.

(10) Patent No.: US 7,281,877 B1
(45) Date of Patent: Oct. 16, 2007

(54) PADFOLIO WITH WORK AREA

(75) Inventors: Joshua B. Lederer, Brookline, MA (US); Mark T. Salander, Barrington, RI (US); Quincy L. Reese, Brockton, MA (US)

(73) Assignee: The Gem Group, Inc., Lawrence, MA (US)

( * ) Notice: Subject to any disclaimer, the term of this patent is extended or adjusted under 35 U.S.C. 154(b) by 530 days.

(21) Appl. No.: 10/922,563

(22) Filed: Aug. 20, 2004

(51) Int. Cl.

| | |
|---|---|
| ***B42F 13/00*** | (2006.01) |
| *B42F 3/00* | (2006.01) |
| *F42D 3/00* | (2006.01) |
| *F42D 17/00* | (2006.01) |
| *F42D 3/18* | (2006.01) |

(52) U.S. Cl. ..... 402/73; 402/70; 402/80 R; 281/31; 281/33; 281/44; 281/51

(58) Field of Classification Search ..... 402/70, 402/72, 73, 80 R, 502; 281/15.1, 29, 30, 281/31, 32, 33, 44, 51

See application file for complete search history.

(56) References Cited

U.S. PATENT DOCUMENTS

| | | | | |
|---|---|---|---|---|
| 1,983,036 | A | 12/1934 | Kaufmann | |
| 2,053,630 | A | 9/1936 | Plotkin | |
| 2,053,695 | A | 9/1936 | Buxton | |
| 2,067,851 | A | 1/1937 | Lifton | |
| 2,113,921 | A | 4/1938 | Mashker | |
| 2,319,127 | A | 5/1943 | Guenther et al. | |
| 2,581,763 | A | 1/1952 | Hickler | |
| 3,023,794 | A | 3/1962 | Lifton | |
| 3,267,980 | A * | 8/1966 | Bird | 150/135 |
| 3,700,148 | A | 10/1972 | Lavin | |
| 3,839,960 | A * | 10/1974 | Bissonet | 101/333 |
| 4,682,310 | A | 7/1987 | Lund et al. | |
| D292,848 | S | 11/1987 | Kim | |
| 4,705,408 | A | 11/1987 | Jordi | |
| 4,796,735 | A | 1/1989 | Horiuchi | |

(Continued)

*Primary Examiner*—Monica Carter
*Assistant Examiner*—Pradeep C Battula
(74) *Attorney, Agent, or Firm*—William A. Loginov; Hinckley, Allen & Snyder LLP

(57) ABSTRACT

This invention provides a padfolio, portfolio or other foldable business accessory that is organized with three hinged leaves (including two main leaves and one overriding leaf that folds over the main leaves when closed together) that may be unfolded and laid flat to expose various internal elements within an overall interior. The elements are organized so that a notepad is provided in a center leaf, while one of the opposing side leaves include a raised clock base having a well or recess for securing a clock having a folding stand that can be raised into an angled, standing position from a flat position. One main leaf also includes a support base that removably supports a personal digital assistant (PDA), that is normally secured flat against the leaf, but that can be hinged upwardly into at least one adjustable angled position whereby the PDA is tilted for easier viewing whilst working in another area of the padfolio, such as the notepad. In this manner, it is more accessible and easier to use. During folding of the leaves, both the clock and the PDA can be secured in a flat orientation for compact storage. The leaves can include, variously, a series of pockets and sleeves for carrying documents, effects and business accessories. In an illustrative embodiment, the a leftmost main leaf can include the pockets the PDA, the center leaf can include the notepad and the overriding leaf includes the clock.

18 Claims, 9 Drawing Sheets

U.S. PATENT DOCUMENTS

| | | | | | |
|---|---|---|---|---|---|
| 4,892,334 | A | | 1/1990 | Sinclair | |
| 5,030,027 | A | | 7/1991 | Bachrach et al. | |
| 5,163,748 | A | | 11/1992 | Messinger | |
| 5,232,301 | A | | 8/1993 | Bianco | |
| 5,340,156 | A | * | 8/1994 | Bianco | 281/37 |
| 5,348,347 | A | * | 9/1994 | Shink | 281/31 |
| 5,351,992 | A | * | 10/1994 | Chilson et al. | 281/31 |
| D352,604 | S | | 11/1994 | Johnson | |
| 5,360,234 | A | * | 11/1994 | Miller et al. | 281/31 |
| 5,375,883 | A | * | 12/1994 | Wyant | 281/37 |
| 5,413,382 | A | | 5/1995 | Cornell et al. | |
| 5,445,251 | A | | 8/1995 | Redwood | |
| 5,527,069 | A | * | 6/1996 | Bianco | 281/37 |
| D381,506 | S | | 7/1997 | Roeder | |
| D383,896 | S | | 9/1997 | Whang | |
| D393,947 | S | | 5/1998 | Alves et al. | |
| D421,526 | S | | 3/2000 | Isaacson | |
| D424,804 | S | | 5/2000 | Isaacson | |
| 6,095,564 | A | * | 8/2000 | Wien | 281/15.1 |
| 6,241,360 | B1 | | 6/2001 | Merrell | |
| 6,558,063 | B2 | * | 5/2003 | Ho | 402/73 |
| 2005/0001420 | A1 | * | 1/2005 | Gordon | 281/33 |
| 2006/0227111 | A1 | * | 10/2006 | Chou | 345/168 |

* cited by examiner

PADFOLIO WITH WORK AREA

BACKGROUND OF THE INVENTION

1. Field of the Invention

This invention relates to portfolios, padfolios and other business accessories.

2. Background Information

Portfolios, padfolios and other compact, foldable business accessories are useful for storing and organizing a variety of documents and other personal/business effects. Typical modern portfolios and padfolios include a notepad, a series of pockets and locations for storing various electronic devices including a calculator, personal digital assistant (PDA) and cellular phone.

Arrangements and structures within a padfolio or portfolio that make it more user-friendly and enhance the function of various devices and accessories are always desirable. Many padfolios or portfolios, while containing desirable pockets and attachments, are not organized to effectively use the items carried in the most efficient manner, or while they remain attached to the portfolio or padfolio. Thus, a more effective organizational arrangement with enhanced device attachment features is highly desirable.

SUMMARY OF THE INVENTION

This invention overcomes the disadvantages of the prior art by providing a padfolio, portfolio or other foldable business accessory that is organized with three hinged leaves (including two main leaves and one overriding leaf that folds over the main leaves when closed together) that may be unfolded and laid flat to expose various internal elements within an overall interior. The elements are organized so that a notepad on a movable flap is provided in a center leaf, while one of the opposing side leaves includes a raised clock base having a well or recess for securing a clock. The clock includes a folding stand so that it can be raised into an angled, standing position from a flat position. One of the opposing side leaves includes a support base that removably supports a personal digital assistant (PDA), that is normally secured flat against the leaf, but that can be hinged upwardly into at least one adjustable angled position whereby the PDA is tilted for easier viewing whilst working in another area of the padfolio, such as the notepad. In this manner, the PDA is more accessible and easier to use.

During folding of the leaves to close the padfolio, both the clock and the PDA can be laid flat on their respective bases and secured in a flat orientation for compact storage. One of the, opposing side leaves (that is hinged to the center leaf) also includes a series of pockets and pouches for carrying various effects and business accessories. One of the pockets can be a zippered-closure "dimensional" pocket with a 1-2-inch projection from the leafs surface for storage of small-but-bulky items. In an illustrative embodiment, the other main leaf can include the pockets, pouches, sleeves and the selectively tilting PDA assembly, while the overriding leaf can include the selectively tilting clock assembly and a secondary smaller-sized notepad having a width and length less than that of the full-size central notepad.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
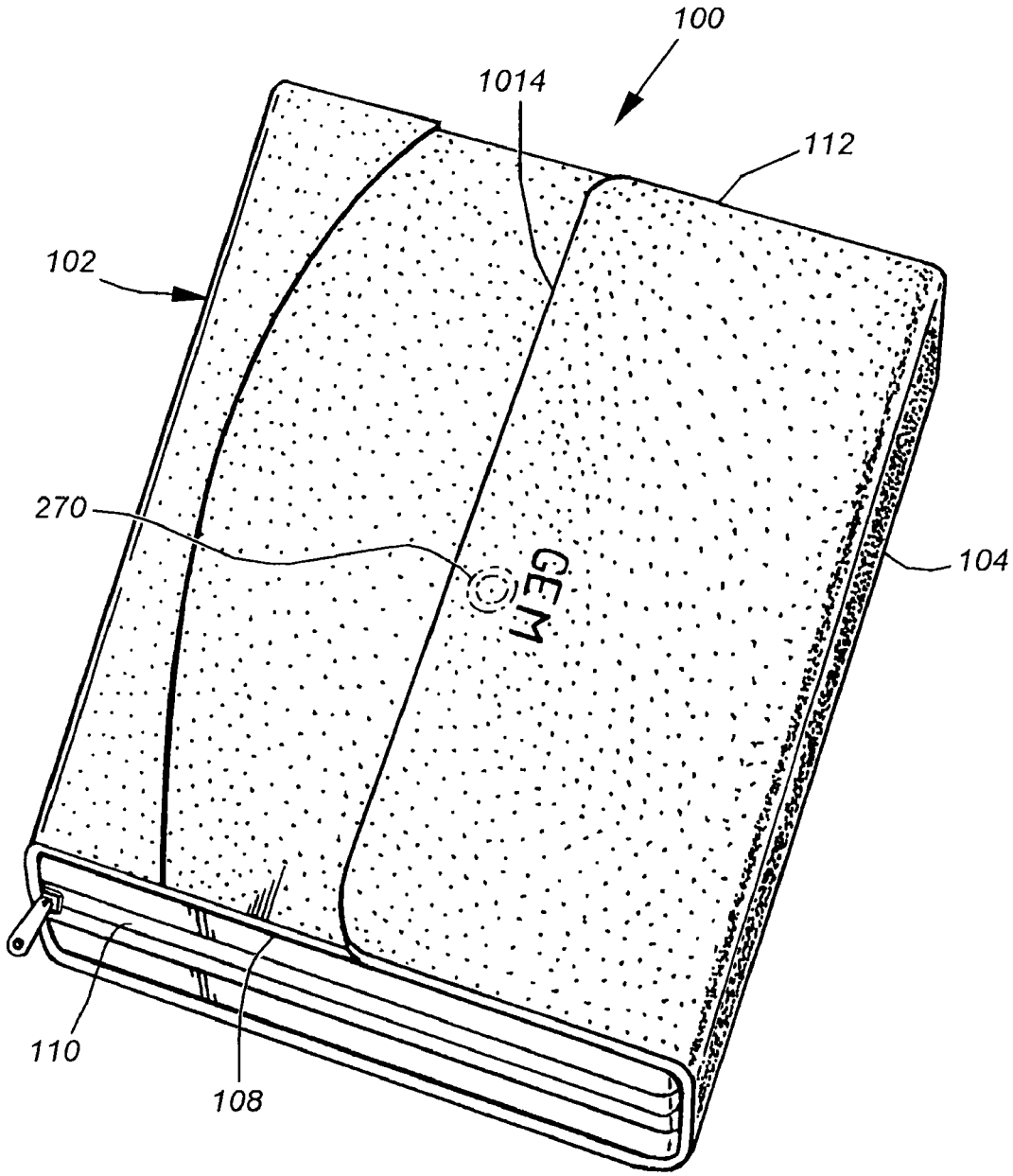
FIG. 1 is a perspective view of a padfolio with work area shown in a closed, folded orientation according to an embodiment of this invention.

FIG. 1 shows the exterior of a padfolio 100 according to an embodiment of this invention. While not shown, the exterior can include a variety of clasps, zippers, additional pockets and surface ornamentation. For the purposes of this illustration, a simplified exterior is shown. In this view, the padfolio is in its completely folded and sealed orientation. The exterior dimensions of the padfolio are highly variable. In general, it is sized with a length and width, when folded, that is approximately equivalent to a number of standard, commercially available portfolios and padfolios. In one example, the width (taken between opposing spines 102 and 104) is approximately 11-12 inches and the height (measured along the spines 102 and 104) is approximately 13-14 inches. The padfolio of this embodiment includes a main folding spine 102 and an opposing third-overriding-leaf folding spine 104. The main folding spine 102 separates two main leaves 108 and 110, while the secondary spine 104 hinges a shortened outer half-leaf 112 that, when folded, overrides the two folded main leaves 108 and 110. The material from which the exterior of the padfolio is constructed is, again, highly variable. Natural or imitation leather, fabric, plastics or a combination of such materials can be used. In general, the exterior surface can include, under the exterior covering material, padding to provide a more pleasing feel to the padfolio. Beneath the padding (not shown) can be provided an arrangement of internal stiffeners constructed from card stock, sheet plastic or another like material that provides rigidity to the leaves. In general, the areas around the folding spines 102 and 104 are free of any stiffeners to allow them to hinge easily.

Figure 2:
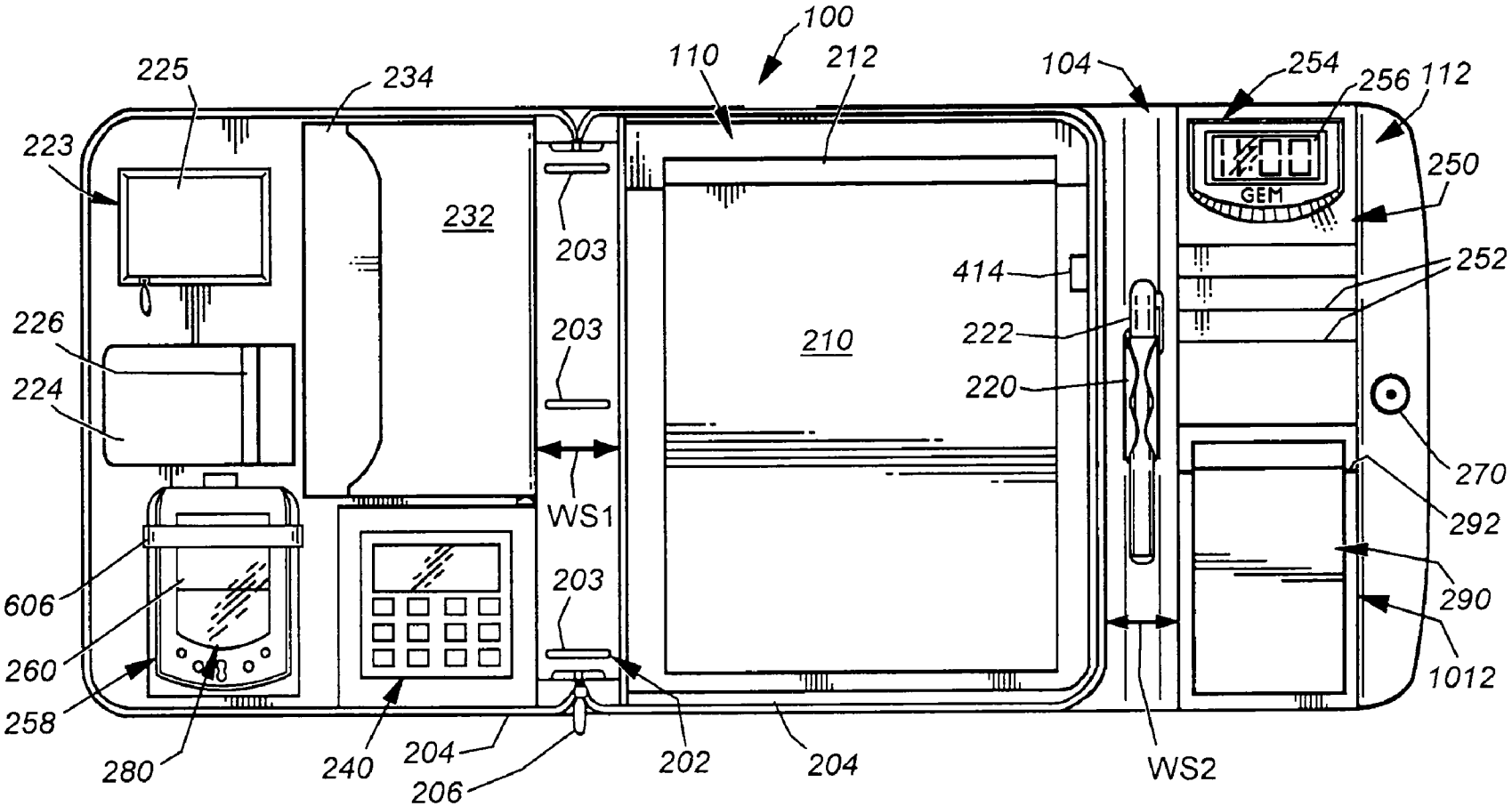
FIG. 2 is a plan view of the padfolio of FIG. 1 shown with each leaf opened and the work area exposed.

With further reference to FIG. 2, the padfolio is shown in an opened orientation with each of the leaves 108, 110 and 112 spread apart and fully exposed to define an overall interior. Note that the interior side of the spine 102 includes, therealong, the three-ring binder mounting 202 of relatively conventional design, with three binder rings 203. The overall width WS1 of the spine 102 is sufficient to accommodate the underlying width of this rigid three-ring binder element. The spine 104 is slightly wider (width WS2) so that it can easily pass around the two main leaves 108 and 110 when they are folded and secured together. The main leaves 108 and 110 can be joined together by a peripheral zipper assembly 204 having at least one pull tab 206 of conventional design. The zipper assembly 204 includes gusset material that is of sufficient height to allow the leaves to be pulled closed with an air space provided therein sufficient to give clearance for the binder and any internal pouches/pockets when filled.

The center leaf 110 includes a flap (described below) houses a conventional notepad 210 having a binding edge 212 at its top. A notepad backing sheet (not shown), typically constructed from rigid cardboard, is inserted into a pocket or retaining sleeve (not shown) on the interior face of the leaf 110. In an alternate embodiment, the notepad and its pocket can be part of a separate leaf that overlies the center leaf interior, but that pivots along a line adjacent to the binding rings 202. This would allow another pocket arrangement or storage area beneath the notepad (on the interior of center leaf 110) to be exposed.

In this embodiment, the centralized notepad 210 acts essentially as the center of an overall work area formed by the three leaves 108, 110 and 112 when unfolded. Placed conveniently next to the notepad is an elastomeric penholder 220 and associated writing implement 222. It is attached to the spine 104 along its interior face using adhesives, stitching or another technique. A version of this pen holder is shown and described in commonly-owned U.S. patent application Ser. No. 10/447,361 entitled PADFOLIO WITH COMPARTMENTALIZED INTERIOR by Agnes Csilla Domotor et al., the teachings of which are expressly incorporated herein by reference. A variety of other placements and attachment techniques for writing implements are expressly contemplated for use herein.

Within the left, main leaf 108 are provided a series of useful pouches, pockets and implements. In this exemplary embodiment, a projecting "dimensional" pocket 223 is provided on the main leaf 108. This pocket is formed with soft material sides (that can be a gusset material and/or a widened zipper material piece) and a zippered top flap 225. It projects upwardly between 1 and 2 inches from the leafs surface, forming a large internal volume in which to store somewhat bulky items including loose change, keys, chargers, etc. On the leaf surface beneath the dimensional pocket 223 is an additional pocket or mounting location 224 with a band 226 for securing an item such as a pad, dictation device or cellular phone. This element 224 can be mounted extending horizontally as shown or positioned vertically where space permits. Beneath the pocket 224 is provided an additional expandable pocket 228 with a zipped closure 230. This pocket can be used to store change or other loose items. A pocket 232 for documents or other larger items is provided beside the pockets 223 and 224. This document pocket 232 includes a sealable flap 234. Beneath this large pocket 232 is provided a calculator 240. The calculator can be any acceptable type of calculating device (solar-powered, etc.). Typically, it is a relatively thin-profile calculator that includes appropriate mountings for being secured to the leaf 108. In one embodiment, the calculator can be surrounded by a windowed frame of material that is adhered around its perimeter edge to the leaf interior surface. The calculator is removed by sliding it out of the frame through an open side. Again, while a variety of pockets, pouches and implements have been shown on the main leaf 108, it is expressly contemplated that the layout and types of accessories provided can be varied significantly depending upon the intended users of the padfolio and their particular needs.

Downward from the pocket 224, on the main leaf 108, is provided a personal digital assistant (PDA) mounting area 258. In this area is provided a conventional, commercially available PDA 260 of the user's choice. This PDA mounting area 258 is described further below.

With particular reference now to the right-hand, overriding flap or leaf 112, the top region of the leaf 112 includes a mounting area 250 having cardholders 252 formed from strips of material. The cardholders are disposed beneath a raised mounting base 254 that mounts an associated digital clock 256. The digital clock 256 and its mounting base 254 are described in further detail below. The width WS2 of the spine 104 is, thus, sufficient to not only surround the thickness of the closed main leaves 108 and 110, but to also accommodate the thickness of the clock when it is laid flush against the interior side of the overriding leaf 112 and the leaf is placed against the exterior of the left main leaf 108 (see FIG. 1). The leaf 112 includes a closure element 270 that is adapted to engage an opposing closure element (not shown) on the outside surface of the left leaf 108. The closure element 270 can be (for example) a snap, hook and loop fastener piece or magnet. The closure is sized in height/projection sufficiently to provide secure closure for the leaf 112 in view of the thickness of the clock 256 in place on the inside face of the leaf 112.

In addition, the shortened right had overriding leaf 112 has, at its bottom, a smaller supplemental notepad 290 (typically 3-4 inches in width by 5-7 inches in length). The notepad 290 is conventional is shape and design, having a stiff backing surface (not shown) that is slid into a sleeve 292 formed on the leaf's surface. By mounting and exposing the clock and a small supplemental notepad, the rightmost leaf 112 provides a handy location for displaying and manipulating information while simultaneously working within the central notepad area on the leaf 110 and the PDA 260 on the left side (leaf 108). Both the clock 256 and the PDA 260 can be maintained in their fixed locations on their respective leaves 112 and 108 or moved readily to another location as needed.

Figure 3:
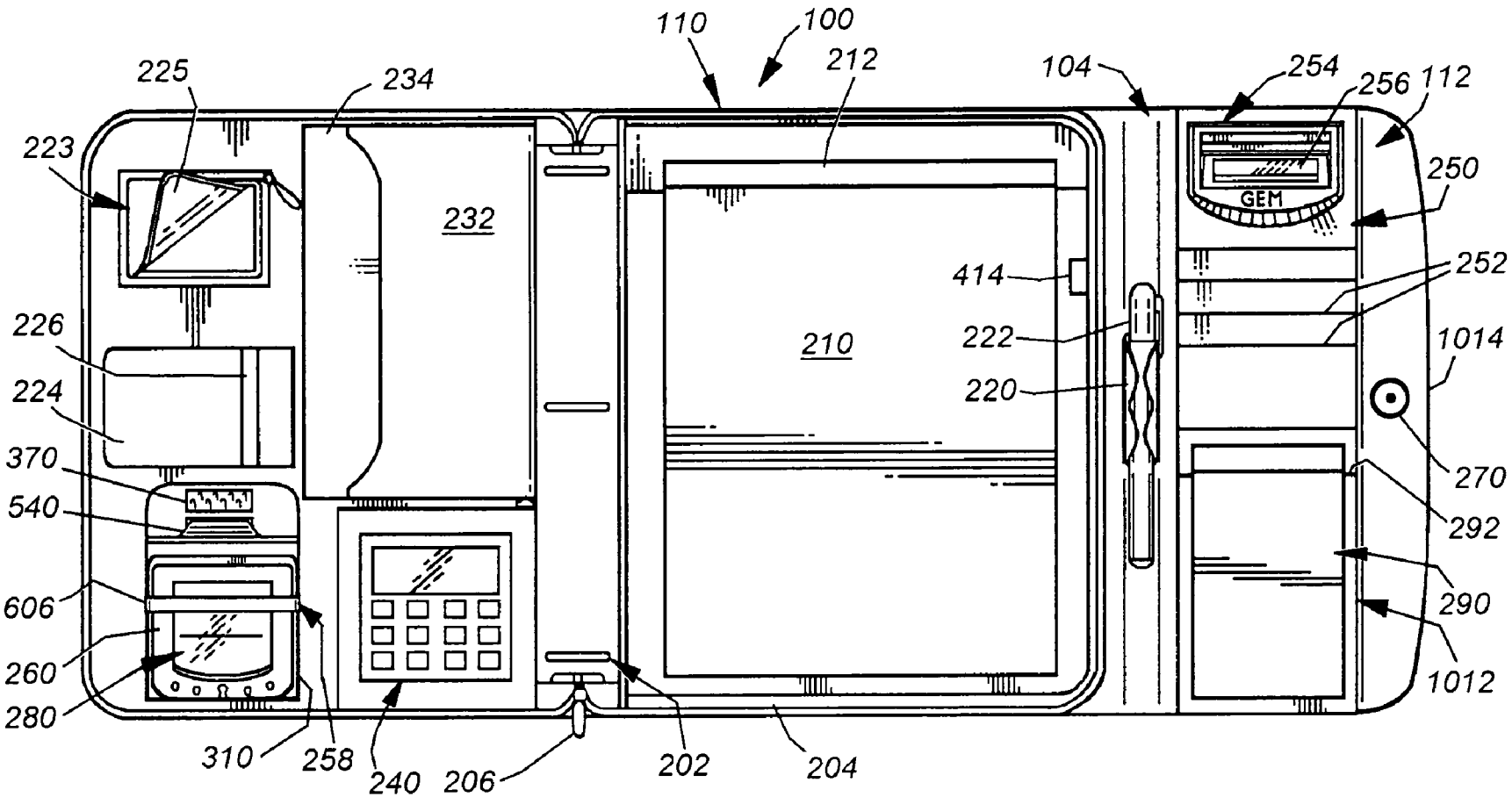
FIG. 3 is a plan view of the padfolio of FIG. 1 further detailing a clock and PDA in an upwardly tilted position.
Figure 4:
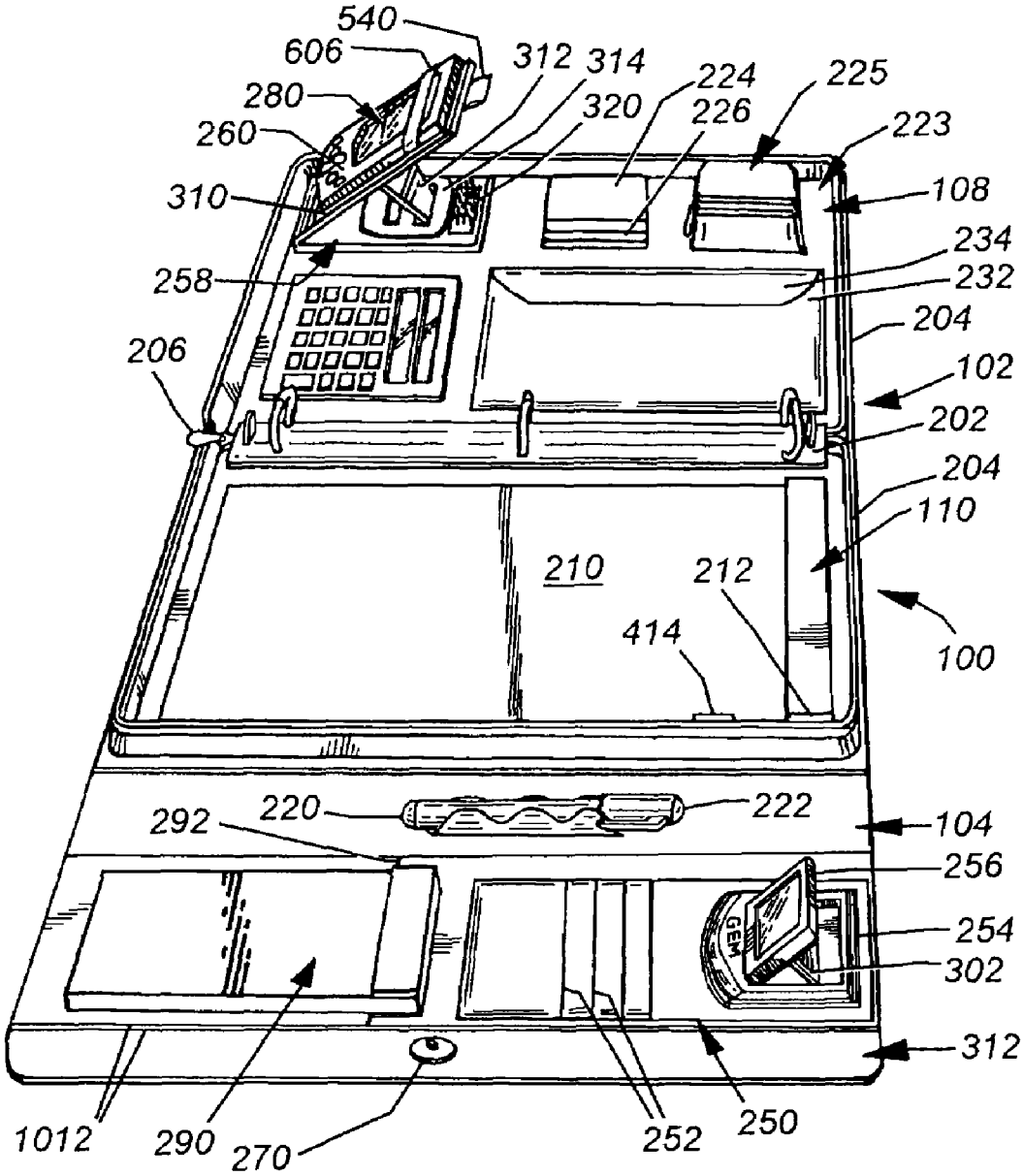
FIG. 4 is a side perspective view of the padfolio of FIG. 1 further detailing the upwardly tilted PDA and clock.

Referring now to FIGS. 3 and 4, the opened PDA 100 is shown with the clock 256 tilted upwardly within its base 254 and resting on an internal stand 302. Likewise, the PDA 260 is tilted upwardly on a hinged base 310 that is supported in this position by a hinged base leg 312 that rests within one of the slots of a leg base 314. In this manner, both the clock and the PDA can be placed in positions on the shortened leaf 112 that make them more suited to quick viewing and easy use while working within other areas of the padfolio. Note also in FIG. 3 that the dimensional pocket 223 is shown with its top flap 225 partially opened (the closure being partially unzipped).

Figure 4A:
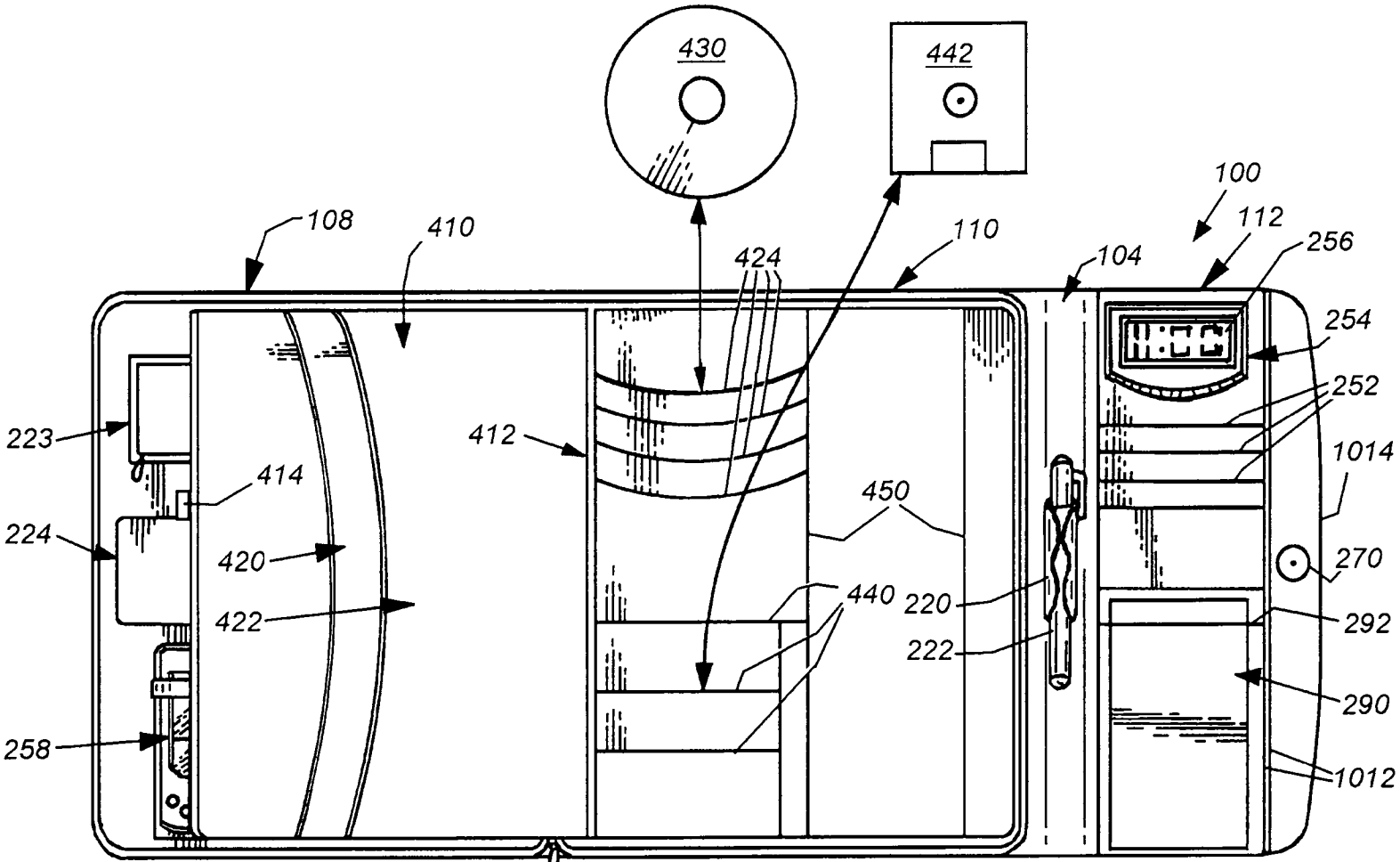
FIG. 4A is a plan view of the padfolio of FIG. 1 shown with the center notepad-carrying flap opened to reveal underlying pockets.

Referring to FIG. 4A, the notepad-carrying flap 410 that is hinged to an edge 412 of the center leaf 110 is shown flipped onto the adjacent left main leaf 108. A pull tab 414 is provided for easy grasping of the flap 410 as it is flipped onto the adjacent leaf 108. In this flipped-open orientation, the flap 410 exposes a set of rear document sleeves 422 and 424. In addition, on the surface of the center leaf 110 is now exposed a series of useful sleeves. One set of sleeves 424 can be used for storing (for example) optical disks. An adjacent, lower set of sleeves 440 is used for diskettes 442. Additional document sleeves 450 are also provided aside the specialized media sleeves 424 and 440. The sleeves can be lined with a variety of materials. For example, a non-scratch liner can be provided to the sleeves 424 to protect delicate compact disks.

Figure 5:
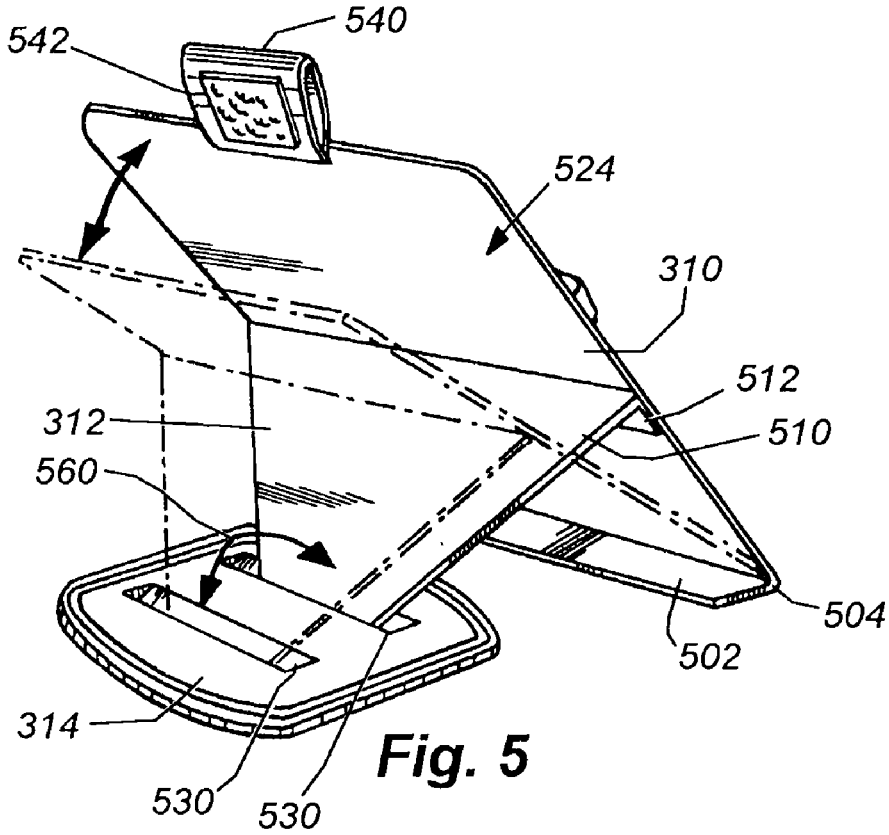
FIG. 5 is a more detailed perspective view of a tilting PDA support stand.
Figure 6:
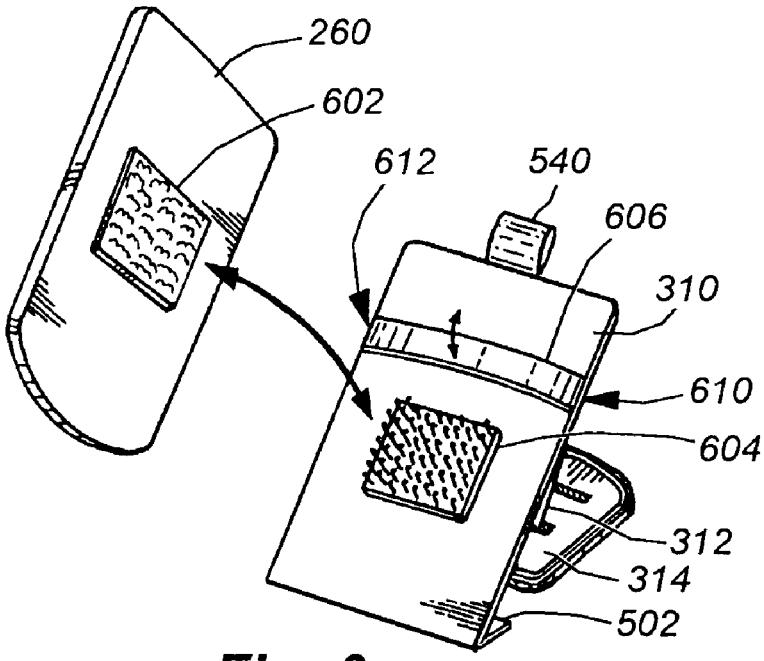
FIG. 6 is an exploded perspective view of the tilting PDA support stand of FIG. 5 showing attachment of a PDA thereto.

The structure and function of the PDA support base 310 are now described further with reference to FIGS. 5 and 6. The support base 310 for mounting the PDA is attached by folded, joined leg 502 with a linear hinge fold 504 defined therebetween. The leg 502 can be attached to the leaf 112 using stitching, adhesives or a variety of other attachment techniques. The internal frame of the PDA support base 310 can be constructed from a variety of materials including card stock, rigid plastic and metal. The support base's internal structure is typically covered with one or more layers of fabric or imitation leather to enhance its appearance. The hinged base leg 312 is, likewise, constructed from a rigid material piece that can be covered for enhanced appearance. The base leg 312 also includes a hinge section 510 that is attached to the backside of the support base 310 and defines a linear hinge fold 512 that allows the leg 312 to rotate from an upstanding position as shown in FIG. 5 to a flat position such as that shown in FIG. 1. In a flattened position, the leg folds flushly against the underside top 524 of the support base 310. In this embodiment, the base leg 312 defines a truncated triangle shape so that the width of the slotted leg base 314 can be narrower than the overall width of the PDA support base 310. In this manner, when completely folded, the slotted leg base 314 is fully obscured by the base support 310. In addition, the narrowed bottom edge of the leg 312 is somewhat easier to handle when inserting into the two alternate supporting slots 530 in the slotted leg base 314. The slotted leg base, in this embodiment, is a solid piece of micromolded plastic or rubber material. In one embodiment, it is constructed from soft polyvinylchloride. It is attached to the interior surface of the leaf 112 by stitching, adhesives and/or other acceptable attachment mechanisms.

At the top edge of the PDA support base 310 is provided a loop of woven material 540. The backside of the loop includes a tab of hook and loop fastener material 542. This fastener material engages opposing hook and loop fastener material (see fastener tab 370 in FIGS. 3 and 4) attached to the interior surface of the leaf 112. In this manner, the support base 310 can be secured to the leaf 112 so that it does not hinge freely away from the leaf when not in use. The size and shape of the hook and loop fasteners 542, 370 and underlying pull loop 540 can be varied depending upon the desired grip strength and grip surface area, respectively. The strength should be sufficient to maintain the PDA firmly against the leaf 112 when not in use and under normal handling conditions, but should be loose enough to allow relatively easy detachment of the support base 310 from the leaf 112.

Referring particularly to FIG. 6, the PDA is, itself, removably attached to the PDA base 310 using a pair of opposing hook and loop fastener pieces 602 and 604. These pieces can be attached to the PDA and base, respectively by adhesives or another method. In one example, the user is provided with at least one piece of self-adhesive fastener material 602 (from any one of a number of commercial sources). The material 602 is secured to the back of the PDA 260 in a convenient location by the user. A corresponding piece 604 is either preattached using adhesives and/or stitching or is also attached by the user to ensure proper alignment. The PDA can, thus, be secured to the base 310 by interengaging the fastener material pieces 602 and 604, and can be detached by providing appropriate tension between the PDA and the base so as to break the bonds of the fastener material. While the hook and loop fastener material (or any other suitable fastening system) can provide sufficient holding strength, extra security is provided using an elastic strap 606 constructed from a woven elastic web that is attached to opposing side edges 610 and 612 of the PDA support base 310. This elastic strap is sized and arranged to overly the upper edge of the PDA as shown generally in FIGS. 2-4. The placement and size (width) of this strap is chosen so that it does not obscure the working buttons or graphical user interface display 280 of most (or all) commonly available PDAs. Where the strap may obscure certain functions of a given PDA model, it can be left unattached, lying flat against the base. In this case, the hook and loop fastener engagement is relied upon exclusively to provide holding force between the PDA and the base. It should be clear that a variety of different mechanisms can be used for removably engaging the PDA and the support base. While hook and loop fastener is an illustrative technique according to one embodiment, a plurality of elastic straps can be used in alternate embodiments. Likewise, a snap or bracket system can be employed in alternate embodiments. It is mainly desired that the PDA be capable of quick and easy removal from the base when needed and that, when attached to the base, can be used an viewed normally while the base is placed in any of a plurality of positions between flat and angled. Also, it is typically desirable that the base and any attachment mechanism be arranged to accommodate a number of different models of available PDA.

Figure 7:
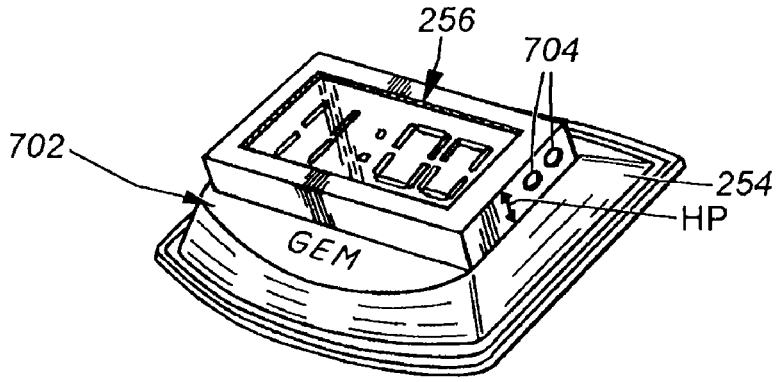
FIG. 7 is a more detailed perspective view of the clock base with clock mounted flatly therein.
Figure 8:
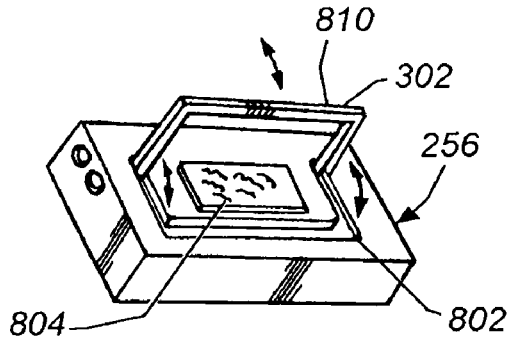
FIG. 8 is a rear perspective view of the clock showing a stand member in a deployed position.
Figure 9:
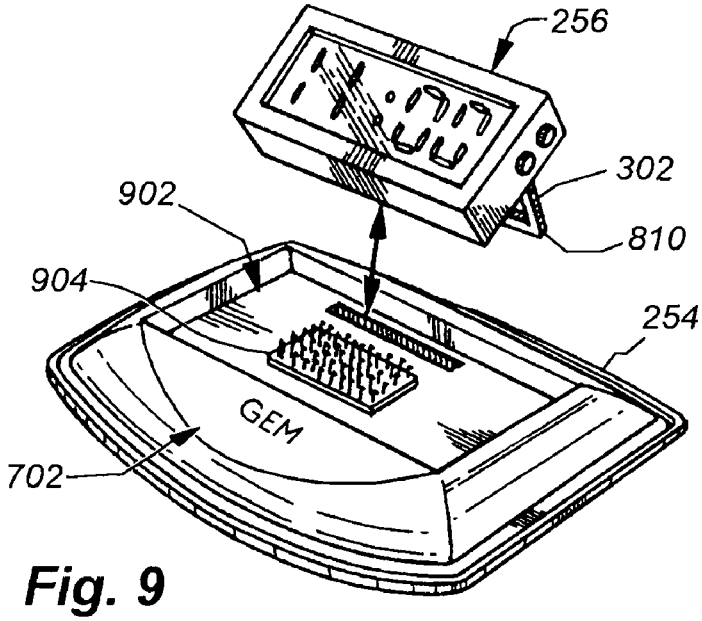
FIG. 9 is an exploded perspective view of the clock being mounted in the stand in a tilted position.

Reference is now made to the clock 256 and its underlying base 254 as shown particularly in FIGS. 7, 8 and 9. The base 254 is constructed from a micromolded plastic or rubber material, soft polyvinylchloride in this example. It can include a logo or other decorative imprint or printing 702 on one or more surfaces. Within the raised base 254 is formed a molded well 902. The well, in this embodiment is rectangular, but it can be any shape that conforms generally to the shape of the clock perimeter. As described above, the backside of the clock 256 in this embodiment includes a hinged stand 302. The stand 302 is adapted to extend from a U-shaped well 802 as shown. When not deployed, the stand 302 resides fully within the U-shaped well 802 and does not project appreciably from the clock's back surface. Along the back surface is provided a piece of self-adhesive hook and loop fastener material 804. This is adapted to engage an opposing piece of hook and loop fastener material 904 mounted within the well. The hook and loop fastener material in the well can be attached by adhesives, stitching or a variety of other attachment techniques. While hook and loop fastener material is used in one embodiment, a variety of other fastening mechanisms including a magnetic fastening system can be employed.

In general, the clock projects sufficiently from the well as shown in FIG. 7 with a height HP of projection so that grasping fingers can remove the clock from the well, overcoming the holding force of the hook and loop fastener material. In this manner, the clock can be removed from the base when needed and, otherwise, remains firmly secured to the base so that it does not fall out. In this embodiment, adjustment buttons 704 for the clock are left exposed along the side of the clock's perimeter walls. Thus, the clock can be set or reset while still in the base. The clock in this example is a digital LCD type, and can include an alarm or other desirable functions. While not shown, a battery hatch can be placed along the backside or at another convenient location at the clock. Within the well is formed a slot 910. The slot is sized and arranged to accommodate the cross bar 810 of the clock. In this manner, as shown generally in FIGS. 3 and 4, the clock can be stood up within the well, having the cross bar 810 seated in the slot 910. In this position, the clock is angled for easy viewing while working in other areas of the padfolio. In addition, the clock can be removed entirely from the base as described above. It can be stood on its stand at a remote location or laid flat.

Figure 10:
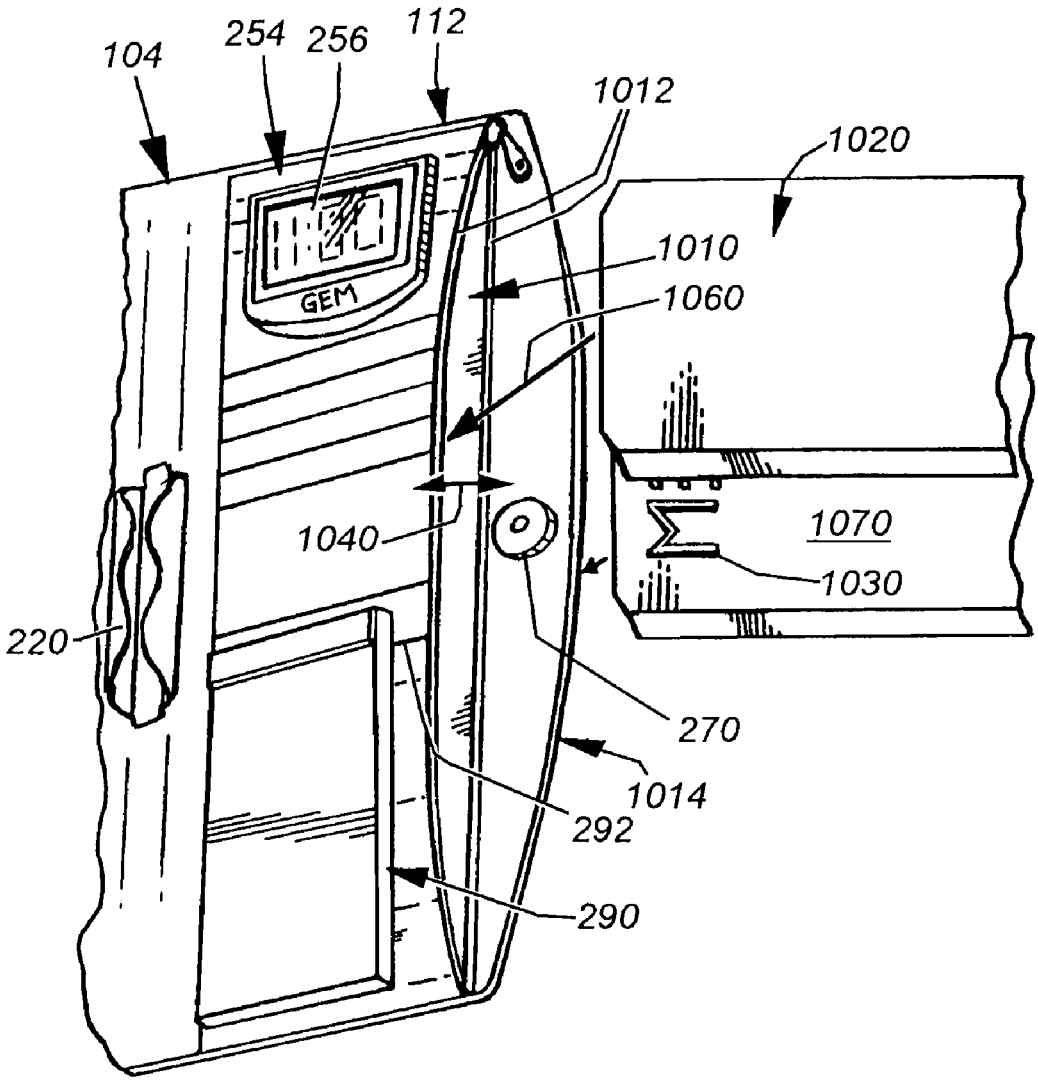
FIG. 10 is a partial perspective view of the shortened overriding leaf of the padfolio of FIG. 1 detailing the application of an external decoration according to an illustrative embodiment.

A further feature of the shortened overriding leaf 112 is an underlying zippered pocket 1010, shown in further detail in FIG. 10. This pocket is defined between the outer side of the leaf 112 and its interior surface, and is accessed by a zippered closure 1012. The closure is a linear seam inboard of the outer (curved) edge 1014 and closure 270. The pocket can be used for further storage of documents and items. It also serves as an entry point for a platen or backing surface 1020 used in the application of a decoration (1030) or embossing to the exterior of the leaf 112. During manufacture or customization, the pocket 1010 is unzipped and spread open (double arrow 1040). The backing surface 1020 is inserted (arrow 1060) into the pocket 1010 and a stamping device 1070 carrying the decoration 1030 is applied to the opposing (exterior) side of the leaf, using the backing surface 1020 to support the leaf's material during the decoration process as pressure is applied by the stamp. After the decoration is applied, the backing surface 1020 is removed and the pocket 1010 may be reclosed.

Figure 11:
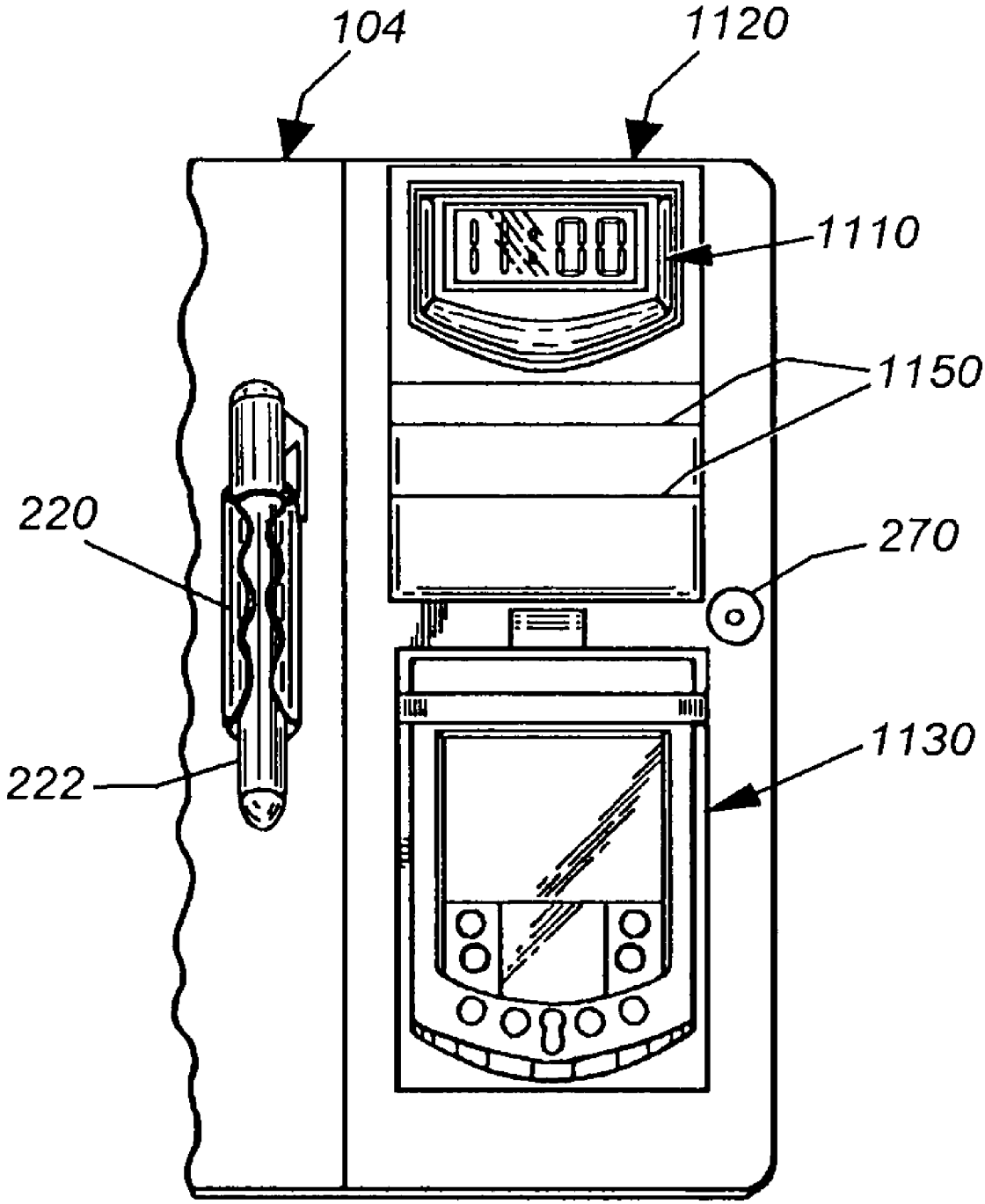
FIG. 11 is a partial plan view of a padfolio according to an alternate embodiment showing an overriding leaf containing both a tilting padfolio and clock.

Aside from a clock assembly 256, a variety of other items can be placed on the shortened overriding leaf of the inventive padfolio. For example, FIG. 11 shows an alternate embodiment in which both the clock (and base) assembly 1110 (of a type generally described above) and a tilting PDA assembly 1130 (of a type generally described above) are both placed on the overriding right leaf 1120. A set of card holders 1150 is also provided beneath the clock in this embodiment. The width of the spine 104 is sufficient to allow the leaf 1120 to be folded over the outside of the left main leaf (108) while accommodating the projection of both the PDA 1130 and clock 1110. In this embodiment the smaller notepad and other features can be relocated to the left main leaf or omitted. In general, the precise placement of electronic devices on this and other leaves can be widely varied.

The foregoing has been a detailed description of an illustrative embodiment of this invention. Various modifications and additions can be made without departing from the spirit and scope thereof. For example, additional leaves, pockets and accessories can be provided to the interior of the padfolio. The materials used to cover the interior of the padfolio can be highly varied and can include plastic, leather and/or fabric. The edge detail of the various leaves of the padfolio can be smooth, stitched or covered with piping. Likewise, the size and number of snaps, closures and fasteners used throughout the padfolio can be varied. Also, while a rectangular LCD digital clock is shown, the clock can be any type (including analog) and have a variety of regular or irregular perimeter shapes. The base well can be adapted to conform to these shapes. Accordingly, this description is meant to be taken only by way of example and not to otherwise limit the scope of the invention.

What is claimed is:

1. A padfolio comprising a pair of main leaves hinged together along a first spine and being secured together with a zippered closure;

an overriding leaf, secured to one of the main leaves and adapted to close over an exterior surface of one of the main leaves when the main leaves are folded together;

a notepad located on an interior surface of a first of the main leaves;

a plurality of pockets and enclosures mounted along an interior surface of a second of the main leaves; and a hinged personal digital assistant (PDA) support base mounted on an interior surface of the second of the main leaves, constructed and arranged to be moved from a flat position flush against an interior surface of the second of the main leaves to at least one angled position with a display and buttons of a PDA removably attached to the support base being exposed and accessible by a user in both the flat position and the angled position.

2. The padfolio as set forth in claim 1 wherein the PDA support base includes a hinged base leg that is removably positionable into at least one slot in a slotted leg base mounted on the interior surface of the overriding leaf so as to maintain the support base in the angled position.

3. The padfolio as set forth in claim 2 wherein the slotted leg base comprises a raised structure having at least two slots so as to define two angled positions, respectively, when the base leg is placed in each of the two slots.

4. The padfolio as set forth in claim 3 wherein the PDA support base includes a hook and loop fastener that interengages an opposing hook and loop fastener on a backside of the PDA so that the PDA is removably mounted to the PDA support base.

5. The padfolio as set forth in claim 4 wherein the PDA support base further includes an elastic strip constructed and arranged to be removably secured over a portion of the PDA in the location that exposes the display and buttons to the user.

6. The padfolio as set forth in claim 5 further comprising a pull loop mounted adjacent an edge of the PDA support base opposite a hinged edge, the pull loop including a hook and loop fastener that removably engages a hook and loop fastener on an interior surface of the second of the two leaves so as to removably secure the PDA base flush against the interior of the overriding leaf.

7. The padfolio as set forth in claim 6 further comprising, mounted on an interior surface of the overriding leaf, a raised clock base having a well for securing therein a clock, the clock being removably mounted to the clock base and including a movable clock stand so that the clock can be relocated from a flat position flush against the clock base to an angled position within the clock base in which the clock is supported by the clock stand.

8. The padfolio as set forth in claim 7 wherein the well includes a slot for receiving the clock stand and each of the clock and the well include a respective piece of hook and loop fastener material for removably securing the clock to the clock base when the clock is laid flat against the clock base.

9. The padfolio as set forth in claim 1 further comprising, mounted on the interior surface of the overriding leaf, a raised clock base having a well for securing therein a clock, the clock being removably mounted to the clock base and including a movable clock stand so that the clock can be relocated from a flat position flush against the clock base to an angled position within the clock base in which the clock is supported by the clock stand.

10. The padfolio as set forth in claim 9 wherein the well includes a slot for receiving the clock stand and each of the clock and the well include a respective piece of hook and loop fastener material for removably securing the clock to the clock base when the clock is laid flat against the clock base.

11. The padfolio as set forth in claim 1 wherein the second of the main leaves further includes a dimensional pocket having a zippered closure flap.

12. The padfolio as set forth in claim 1 wherein the overriding leaf defines an outer edge and further comprising a pocket defined between an exterior surface of the overriding leaf and the interior surface constructed and arranged to receive a backing surface that allows a decoration to be stamped on the exterior surface.

13. The padfolio as set forth in claim 12 wherein the pocket defined between an exterior surface of the overriding leaf and the interior surface includes a zippered closure.

14. The padfolio as set forth in claim 1 wherein the interior surface of the overriding leaf further comprises a secondary notepad mounted thereon, wherein the secondary notepad has a length and a width each being less than a respective length and width of the notepad mounted the first of the main leaves.

15. The padfolio as set forth in claim 1 wherein the center leaf includes a hinged flap upon which the notepad is mounted, the center leaf being movable to selectively expose a plurality of sleeves located on at least one of an interior surface of the first of the two leaves and a reverse surface of the hinged flap.

16. A padfolio comprising:

a left main leaf;

a center leaf;

a right overriding leaf, adapted to close over the left main leaf and the center leaf when each of the left main leaf and the center leaf are folded into a closed relationship, and each of the left main leaf, center leaf and right overriding leaf defining an overall interior when fully unfolded;

a notepad located within the interior;

a plurality of sleeves and pockets located within the interior; and a selectively tilting PDA assembly located within the interior, constructed and arranged to be moved from a flat position flush against an interior surface to at least one angled position.

17. The padfolio as set forth in claim 16 further comprising a selectively tilting clock assembly located within the interior.

18. The padfolio as set forth in claim 17 wherein the notepad is located adjacent to the center leaf, the PDA assembly is located adjacent to the left main leaf and the clock assembly is located adjacent to the right overriding leaf.

* * * * *